United States Patent [19]

Rocheleau

[11] Patent Number: 4,863,171

[45] Date of Patent: Sep. 5, 1989

[54] BINGO DABBER

[75] Inventor: Roger Rocheleau, Hammer, Canada

[73] Assignee: Rocheleau Dabber Corporation, Ontario, Canada

[21] Appl. No.: 194,090

[22] Filed: May 16, 1988

[30] Foreign Application Priority Data

Mar. 4, 1988 [CA] Canada ..... 560588

[51] Int. Cl.[4] ..... A63F 9/00; B43K 27/08

[52] U.S. Cl. ..... 273/148 R; 401/34; 401/206

[58] Field of Search ..... 273/148 R, 34, 35, 196, 273/202, 206

[56] References Cited

U.S. PATENT DOCUMENTS

| | | | |
|---|---|---|---|
| 1,267,521 | 5/1918 | Dover | 401/206 |
| 2,314,394 | 3/1943 | Guy | 401/206 X |
| 2,517,060 | 8/1950 | Villarin | 401/34 |
| 3,006,024 | 10/1961 | Nelson et al. | 401/196 X |
| 3,565,294 | 2/1971 | Schwartzman | 401/196 X |
| 3,858,986 | 1/1975 | Gilbert | 401/34 |
| 4,509,875 | 4/1985 | Shintani | 401/34 |

FOREIGN PATENT DOCUMENTS

| | | | |
|---|---|---|---|
| 848111 | 8/1970 | Canada | 401/206 |

*Primary Examiner*—Anton O. Oechsle

*Attorney, Agent, or Firm*—Jones, Tullar & Cooper

[57] ABSTRACT

A dabber for marking items such as bingo cards has a hollow head portion and a hollow handle portion providing the overall appearance of a hammer. The head portion has a check-valve operated applicator at each end, the applicators preferably being of different diameters. The head and handle portions are filled with a colored, indelible, transparent non-toxic ink. During use the player applies the desired applicator to the desired location by using a smooth, soft hammer-like motion while gripping the handle portion of the dabber. The dabber is cleaner and easier to use than prior art dabbers.

4 Claims, 3 Drawing Sheets

BINGO DABBER

The present invention relates to a so-called "dabber", a device for marking sheets of paper, such as bingo cards, with an indelible but transparent spot of ink.

BACKGROUND OF THE INVENTION

Thousands of people play the game of "BINGO", at home or at fairs or at bingo halls. The game utilizes cards which typically carry 25 numbers thereon in 5 rows and columns. As numbers are called out the players cover the called numbers on their cards until a predetermined set of numbers has been covered, at which point the player is a "winner". The predetermined set may be a line of 5 numbers running vertically, horizontally or corner-to-corner on the card or it might be the entire card.

It is necessary to keep track of the numbers that have been called during any particular game. Typically this has been done by covering the called number on one's card with a small disc. The disadvantage of this is that it is easy to displace the discs if the card is accidentally moved, thereby making it difficult for the player to resume play, unless he can remember the exact location of his discs.

An alternative to the use of discs is the so-called "dabber", a cylindrical bottle filled with an indellible but transparent ink and having a check-valve operated applicator head, usually of a foam material. When a number is called the player inverts the bottle and presses the head on the number called. A colored spot is left by the head on the called number. While these dabbers are an advance over discs they too have certain drawbacks. For example, the check-valves occasionally leak and ink can run onto the body of the bottle, staining the player's hand if he grips the bottle while the ink is still wet. Also, if the player is using a card which is destroyed after each game he might use the dabber having a large head whereas if the card is to be reused he might want to use a small-headed dabber so that a plurality of spots can be placed on or about the called number. This means that the player has to carry at least two dabbers with him.

SUMMARY OF THE INVENTION

The present invention overcomes the problems of the prior art by providing a dabber in which the body thereof is essentially in the shape of a hammer whereby the dabber is provided with a handle. This avoids the problem of stained hands in the event of ink leakage from the applicator head.

The working end, or head, of the present invention is also provided with two oppositely directed applicators of different diameters. Thus, by merely turning the handle through 180° on its axis the player can choose between large- and small-diameter applicators.

The head portion of the present invention is hollow and contains ink for both applicators. Also the handle portion itself may be hollow, providing a large reservoir of ink, much larger than is available with presently-available cylindrical dabbers.

Broadly speaking therefore, the present invention may be considered as providing a dabber for applying a spot of ink to an article at a desired location comprising an elongated, hollow head portion adapted to contain a supply of the ink, a check-valve operated ink applicator at at least one end of the head portion, and an elongated handle portion secured to the head portion intermediate the length thereof and extending away from the head portion substantially at right angles thereto.

DESCRIPTION OF THE PREFERRED EMBODIMENT

Figure 1:
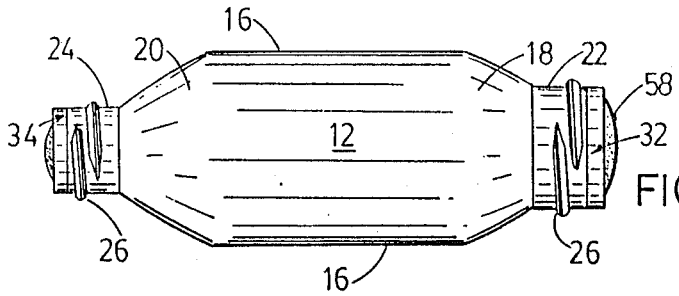
FIG. 1 shows a top view of the dabber of the present invention.
Figure 2:
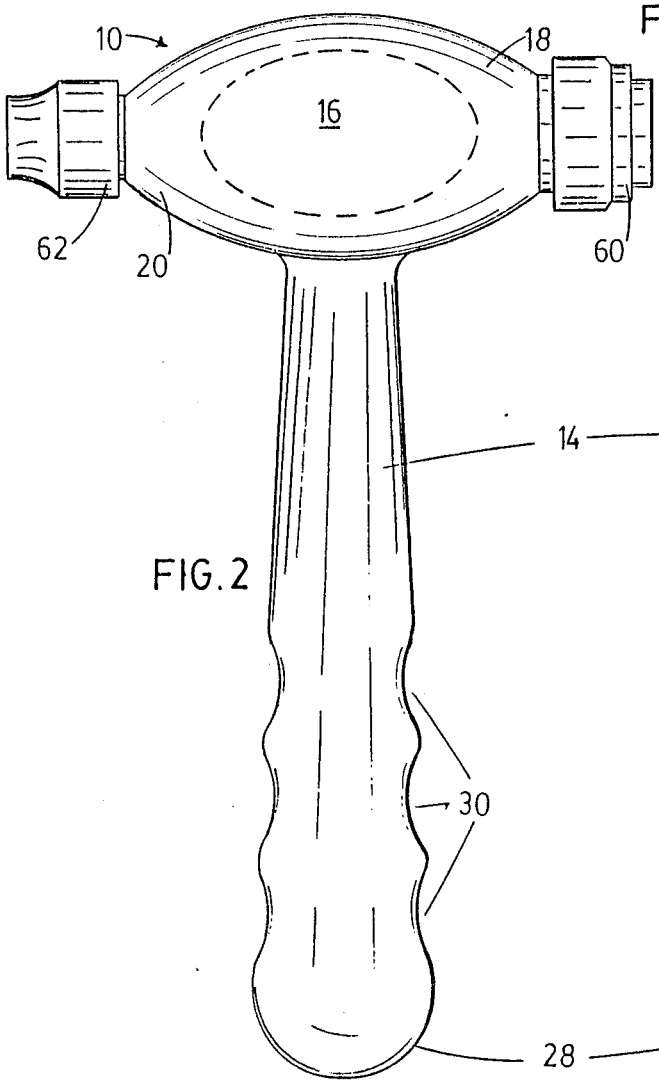
FIG. 2 shows a side view of the dabber of the present invention.
Figure 3:
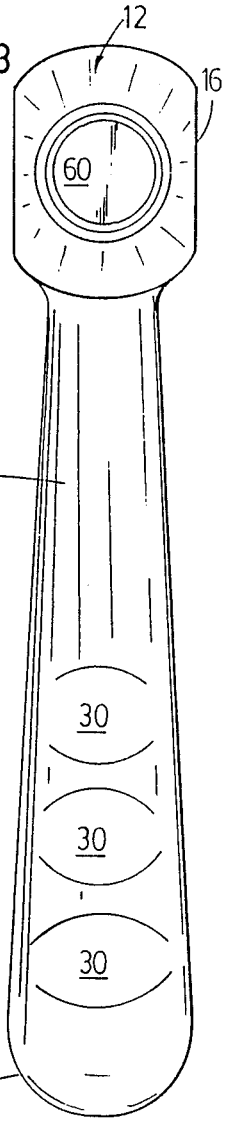
FIG. 3 shows an end view of the dabber of the present invention.

With reference to FIGS. 1, 2 and 3 the dabber 10 of the present invention includes an elongated hollow head portion 12 and a handle portion 14 extending away from the head portion generally at right angles thereto. Preferably the head portion 12 and handle portion 14 are integrally molded together, as by blow molding, so that both portions of the dabber are hollow and interconnected to provide a large reservoir for ink. As an alternative, not shown, the head portion 12 could be separate from the handle portion 14 with the two portions being assembled together after molding. The handle portion could be hollow with there being a molded threaded fluid connection between the portions; or there need be no fluid connection between the portions.

The head portion 12 has flat sides 16 on which advertising or identification labels can be affixed. The head portion 12 tapers at the ends, as at 18,20 to annular flanges 22,24, each carrying external threads 26 thereon. Flange or collar 22 is of a larger diameter than flange 24 and hence the length of taper 20 is greater at the end having the smaller diameter flange 24.

The handle portion 14 is generally circular about its periphery and the diameter increases gradually from adjacent the head portion 12 to the hemispherical lower end 28. Arcuate depressions 30 are molded into the handle portion 14 on opposite sides thereof, generally in line with the long axis of the head portion 12. The depressions 30 act as finger grips for the player and help to orient the head portion in the correct plane for effective usage.

Figure 4:
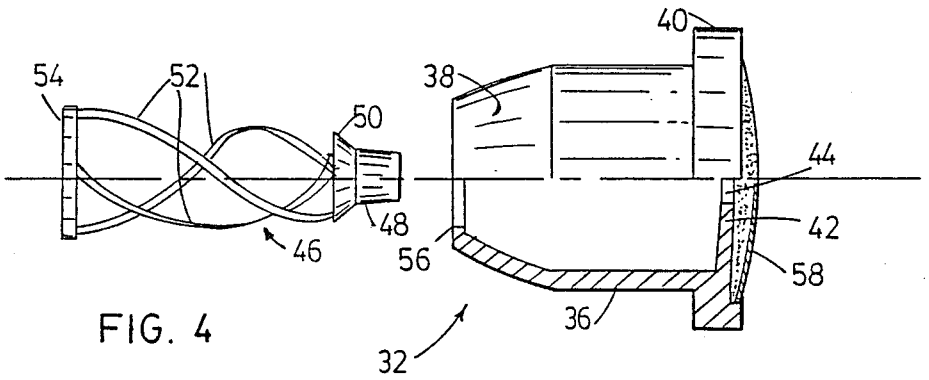
FIG. 4 shows an exploded partially sectioned view of a commercially available check valve that is used with the dabber of the present invention.

With reference now to FIGS. 1 and 4 it is seen that the head portion 12 is provided with a large-diameter check-valve operated applicator 32 and a similar, but small-diameter, applicator 34. The applicators 32,34 are available commercially but one, applicator 32, is shown in FIG. 4 for the sake of completeness.

Applicator 32 includes a cylindrical body 36 having a tapered end 38 and a larger diameter collar 40 at the other end. The body 36 is sized so that it will fit tightly in the flanged end 22 of the head portion 12, with the collar 40 abutting the annular end of flange 22 and having the same outer diameter thereof.

Internally, the body 36 has an annular flange 42 defining a circular opening 44, around which the flange 42 defines a valve seat. A molded combination check-valve and spring assembly 46 has a valve head 48 that normally fits within opening 44 and an outwardly flared skirt 50. The skirt 50 has integrally affixed thereto three spirally rearwardly extending spring members 52 which terminate at a circular ring 54. When the assembly 46 is pushed into the body 36 the head 48 enters the opening 44, the skirt 50 abuts the valve seat defined by flange 42 and ring 54 fits behind a slight annular flange 56 formed at the tapered end 38 of the body 36.

A circular piece 58 of foam material is adhered or otherwise affixed to the flange 42 on the forward side thereof so as to cover the opening 44 and the projecting head 48.

Internally threaded caps 60,62 are provided to threadedly engage the threads 26 on the flanges 22,24 respectively to cover the applicators 32,34 when not in use.

The dabber of this invention will normally be sold with a non-toxic colored ink (red, green, etc.) therein. When the dabber is being assembled one of the applicators 32,34 is press fit into its respective flange 22,24; the handle and head portions 14,12 are filled with ink through the other flange 24,22; and then the other applicator 34,32 is press fit into its flange thereby capturing the ink within the dabber. Caps 60,62 are threaded onto the flanges 22,24 and the dabber is ready for sale.

When using the dabber of this invention one removes the cap 60 or 62 to expose the desired applicator 32 or 34 and then using a normal, but soft, hammering motion one brings the applicator 32 or 34 into contact with the bingo card at the desired location, leaving an appropriately sized spot at that location. Contact of the foam material 58 with the card moves the head 48 and skirt 50 rearwardly within body 36, allowing ink to pass through opening 44 to the foam material, from which it is transferred to the card. When contact with the card is broken the springs 52 push the skirt 50 back to the valve seat to prevent ink movement through the opening 44.

The dabber can be laid on its side when not in use, with no fear of unwanted movement as is possible with cylindrical dabbers. Any leakage of ink past the collar 40 can be wiped away easily. If such leakage is unnoticed the user need not stain his hands since he grips only the handle portion 14 and not the head portion 12. Furthermore, with one device, the bingo player can quickly decide on the size of spot to be used and he can then use the appropriate applicator without having to carry two separate dabbers. Thus the dabber of the present invention has many advantages over previously available single-headed dabbers.

Figure 5:
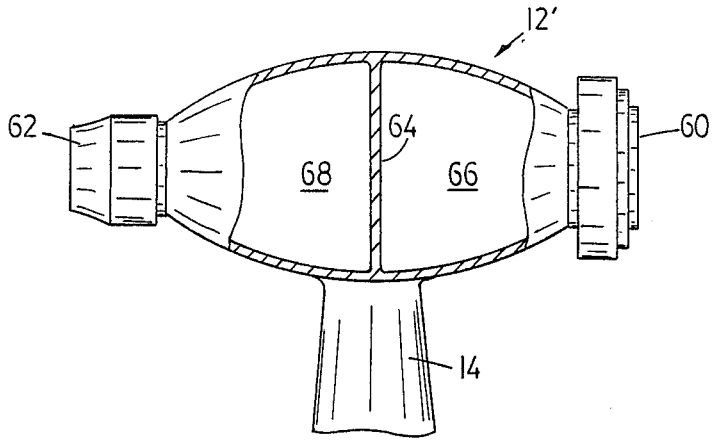
FIG. 5 shows a partially sectioned view of an alternative head arrangement for the dabber of the present invention, wherein the head is internally divided into two compartments.

It is likely that skilled persons in the art could effect changes to the present invention without departing from the spirit thereof. For example one could design the head portion 12 so that it has only one applicator therein, the other end of the head portion being permanently closed. Alternatively the applicators 32,34 could be of the same size. As shown in FIG. 5, the head portion 12' could be internally transversely divided into two hollow compartments by a wall 64 so that ink of one color could be provided in compartment 66 for use with the adjacent applicator 32 and ink of another color could be provided in compartment 68 for use with adjacent applicator 34. The two applicators 32 and 34 are in fluid communication with their adjacent compartments 66 and 68, respectively. Needless to say, the protection to be afforded the present invention is to be determined from the claims appended hereto.

The embodiments of the invention in which an exclusive property or privilege is claimed are defined as follows:

1. A dabber for applying a spot of ink to an article at a desired location comprising an elongated hollow head portion adapted to contain a supply of ink, a check-valve operated ink applicator at each end of said head portion in fluid communication with the interior of said head portion, and an elongated hollow handle portion integrally formed with said head portion and in fluid communication therewith intermediate the length of said head portion and extending away therefrom substantially at right angles thereto.

2. The dabber of claim 1 wherein said applicators are of different diameters.

3. The dabber of claim 1 wherein said handle portion includes finger grip recesses in the surface thereof adjacent the distal end thereof.

4. A dabber for applying a spot of ink to an article at a desired location, comprising:

an elongated hollow head portion internally transversely divided into two hollow compartments, each adapted to contain ink of a different color;

a check-valve operated ink applicator at each end of said head portion, the applicator at one end of said head portion being in fluid communication with the adjacent one of said compartments and the applicator at the other end of said head portion being in fluid communication with the other of said compartments; and an elongated handle portion secured to said head portion intermediate the length thereof and extending away from said head portion substantially at right angles thereto.

* * * * *